US011850465B2

(12) United States Patent
Brown et al.

(10) Patent No.: US 11,850,465 B2
(45) Date of Patent: Dec. 26, 2023

(54) APPARATUS FOR PROVIDING SUSPENSION AND RESISTANCE TRAINING

(71) Applicants: Kristopher M. Brown, Dallas, TX (US); Lourdes C. Brown, Dallas, TX (US)

(72) Inventors: Kristopher M. Brown, Dallas, TX (US); Lourdes C. Brown, Dallas, TX (US)

(73) Assignee: Kristopher M. Brown, Dallas, TX (US)

( * ) Notice: Subject to any disclaimer, the term of this patent is extended or adjusted under 35 U.S.C. 154(b) by 9 days.

(21) Appl. No.: 17/721,087

(22) Filed: Apr. 14, 2022

(65) Prior Publication Data

US 2023/0330474 A1 Oct. 19, 2023

(51) Int. Cl.
*A63B 21/00* (2006.01)
*A63B 21/02* (2006.01)
(Continued)

(52) U.S. Cl.
CPC ..... *A63B 21/153* (2013.01); *A63B 21/023* (2013.01); *A63B 21/0442* (2013.01); *A63B 21/0555* (2013.01)

(58) Field of Classification Search
CPC . A63B 21/0555; A63B 21/153; A63B 21/023; A63B 21/0442; A63B 21/00185;
(Continued)

(56) References Cited

U.S. PATENT DOCUMENTS 2,716,027 A 8/1955 Gehri
4,815,731 A * 3/1989 Suarez ..... A63B 21/055 482/126

(Continued)

FOREIGN PATENT DOCUMENTS

CN 206660417 U 11/2017
CN 210384691 U 4/2020

OTHER PUBLICATIONS

Recoil Store; "Recoil S2 Gym—Premium Quality Suspension Trainer—Unmatched Performance—Full Body Workout—All Fitness Levels;" Recoil Store item for purchase on Amazon.com.

*Primary Examiner* — Loan B Jimenez
*Assistant Examiner* — Kathleen M Fisk
(74) *Attorney, Agent, or Firm* — Scott Griggs; Griggs Bergen LLP

(57) ABSTRACT

An apparatus for providing suspension and resistance training is disclosed. In one embodiment, a main strap includes a fastener for engaging an anchor at an upper end and a connection point that accepts a load at a lower end. A retraction unit, which provides non-load redundancy to the main strap, includes a coupling member securing the retraction unit to the fastener. The main strap is threaded through the ring end fitting. In an extended configuration, the retractable cable is fully extended, and the length of the main strap is fully extended with the main strap having a non-load transferring relationship to the retraction unit in the extended configuration. In an unloaded retracted configuration, the retractable cable is at least partially retracted into the retraction unit and the length of the main strap is less than fully extended.

10 Claims, 3 Drawing Sheets

(51) Int. Cl.
*A63B 21/055* (2006.01)
*A63B 21/04* (2006.01)

(58) Field of Classification Search
CPC ..... A63B 21/068; A63B 21/02; A63B 21/04; A63B 21/055–0557; A63B 7/00–02; A63B 7/08; A63B 22/0002; A63B 23/035; A63B 23/12–1281
See application file for complete search history.

(56) References Cited

U.S. PATENT DOCUMENTS

| | | | | |
|---|---|---|---|---|
| 6,440,002 | B1 * | 8/2002 | Jackson | A63G 9/00 472/125 |
| 7,621,856 | B1 | 11/2009 | Keith et al. | |
| 7,827,895 | B2 * | 11/2010 | Wang | A63B 21/0552 87/9 |
| 7,892,157 | B2 | 2/2011 | Arnett | |
| 8,152,704 | B2 * | 4/2012 | Brice | A63B 21/1645 482/904 |
| 9,889,332 | B2 | 2/2018 | Bowles | |
| 10,232,212 | B1 | 3/2019 | Cohen | |
| 11,141,621 | B2 * | 10/2021 | Kushner | A63B 21/4043 |
| 2011/0237407 | A1 * | 9/2011 | Kaleal | A63B 23/03541 482/114 |
| 2014/0155233 | A1 * | 6/2014 | Latronica | A63B 23/1272 482/139 |
| 2015/0335937 | A1 * | 11/2015 | Park | A63B 21/4043 482/121 |
| 2019/0001175 | A1 | 1/2019 | Wagner et al. | |
| 2022/0176183 | A1 * | 6/2022 | Turner | A63B 23/1218 |
| 2022/0249895 | A1 * | 8/2022 | d'Anconia | A63B 21/285 |

* cited by examiner

APPARATUS FOR PROVIDING SUSPENSION AND RESISTANCE TRAINING

TECHNICAL FIELD OF THE INVENTION

The present disclosure relates, in general, to suspension training, and more particularly, to an apparatus for providing suspension and resistance training that allows a user to work against his or her own body weight.

BACKGROUND OF THE INVENTION

Suspension training refers to an approach to strength training that uses a system of ropes and webbing called a "suspension trainer" to allow a user to work against his or her own body weight. Many studios, such as yoga studios, Pilates studios, multi-use gyms and other athletic facilities, cannot afford to permanently affix suspension training points as a sole source for suspension training as studio space is limited and equipment space utilization is compromised. Accordingly, there is a need for improved apparatuses for providing suspension and resistance training.

SUMMARY OF THE INVENTION

It would be advantageous to achieve an apparatus for providing suspension and resistance training that would improve upon existing limitations in functionality with respect to studio space and equipment space utilization. It would also be desirable to enable a mechanical-based solution that would provide simplified and accelerated storage and deployment of exercise equipment. To better address one or more of these concerns, an apparatus for providing suspension and resistance training is disclosed. In one embodiment, a main strap includes a fastener for engaging an anchor at an upper end and a connection point that accepts a load at a lower end. A retraction unit, which provides non-load redundancy to the main strap, includes a coupling member securing the retraction unit to the fastener. The main strap is threaded through the ring end fitting. In an extended configuration, the retractable cable is fully extended, and the length of the main strap is fully extended with the main strap having a non-load transferring relationship to the retraction unit in the extended configuration. In an unloaded retracted configuration, the retractable cable is at least partially retracted into the retraction unit and the length of the main strap is less than fully extended.

In another embodiment, a main strap includes a fastener for engaging an anchor at an upper end and a connection point that accepts a load at a lower end. The main strap is threaded through the ring end fitting and at least a portion of the main strap includes an engineered stretchable cord, which may include a spring coil around the main strap or a bungee cord at least partially integrated with the main strap. In an extended configuration, the engineered stretchable cord is fully extended, and the length of the main strap is fully extended with the main strap having a non-load transferring relationship to the retraction unit in the extended configuration. In an unloaded retracted configuration, the engineered stretchable cord is at least partially retracted and the length of the main strap is less than fully extended. These and other aspects of the invention will be apparent from and elucidated with reference to the embodiments described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Referring initially to FIG. 1 through FIG. 5, therein is depicted one embodiment of an apparatus for providing suspension and resistance training in a first position, which is illustratively presented and designated 10. In some embodiments, the apparatus 10 may provide supplemental equipment used for exercise, whether as a single user exercise device or an equipment option for group fitness. As shown, the apparatus 10 is positioned within studio S having walls W, a ceiling C, and a floor F. Inherent aspects of the apparatus 10 require anchoring to a safe and reliable structure. The apparatus 10 is depicted as being mounted to the ceiling C, but the apparatus 10 may alternatively be mounted to one of the walls W, a cantilever, or specialized a-frame truss support, for example.

Figure 2:
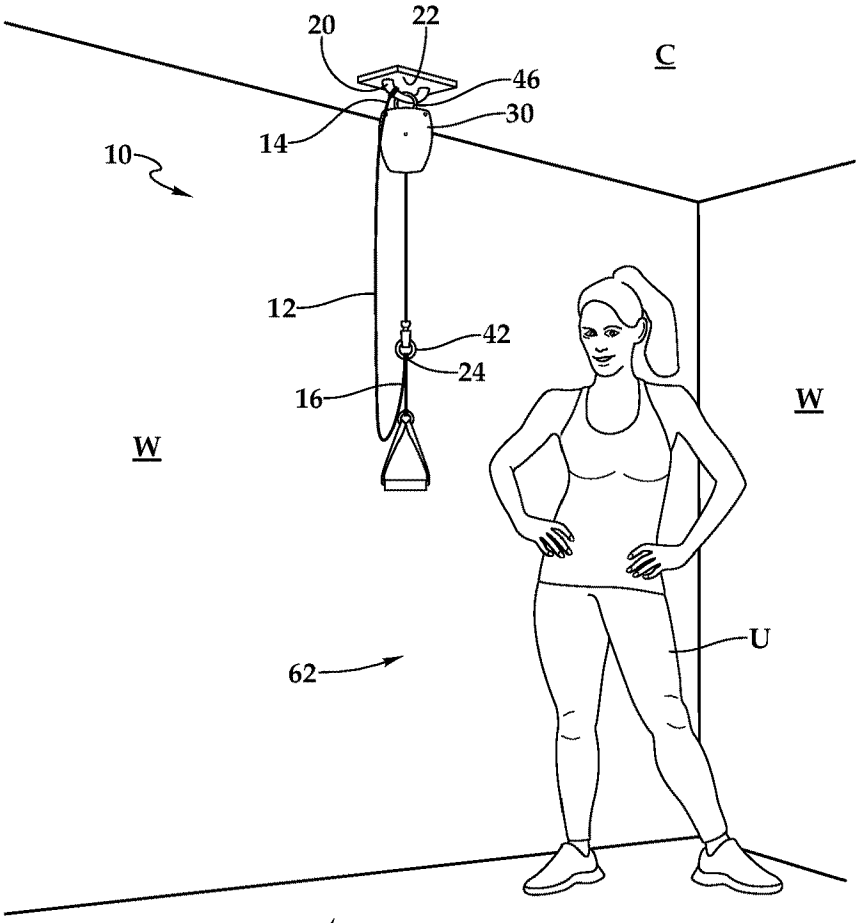
FIG. 2 is a front perspective view of the apparatus for providing suspension and resistance training depicted in FIG. 1 in a second position.
Figure 1:
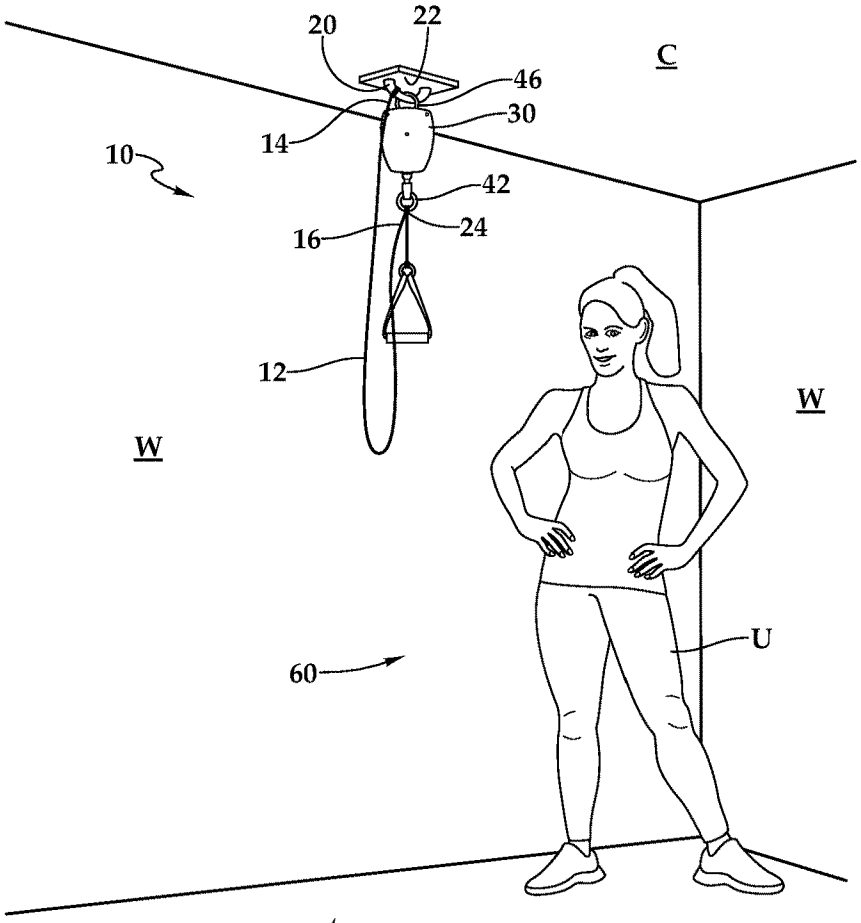
FIG. 1 is a front perspective view of one embodiment of an apparatus for providing suspension and resistance training in a first position, according to some exemplary aspects of the teachings presented herein.
Figure 4:
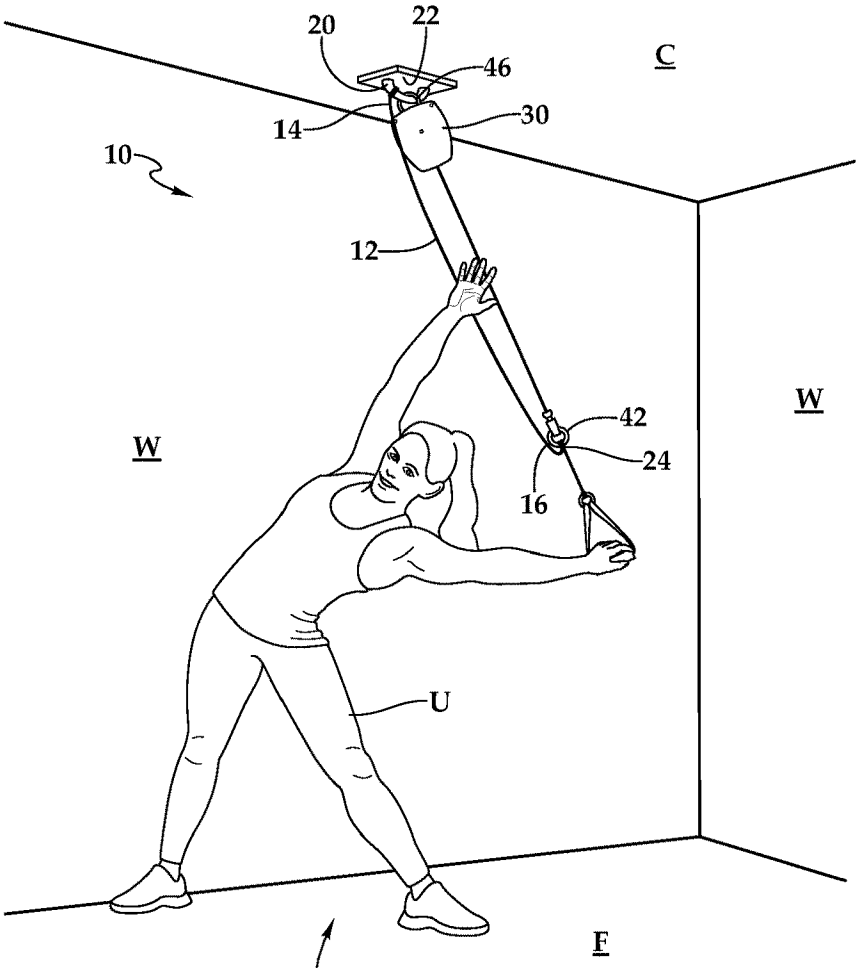
FIG. 4 is a front perspective view of the apparatus for providing suspension and resistance training depicted in FIG. 1 in the third position with a load.
Figure 3:
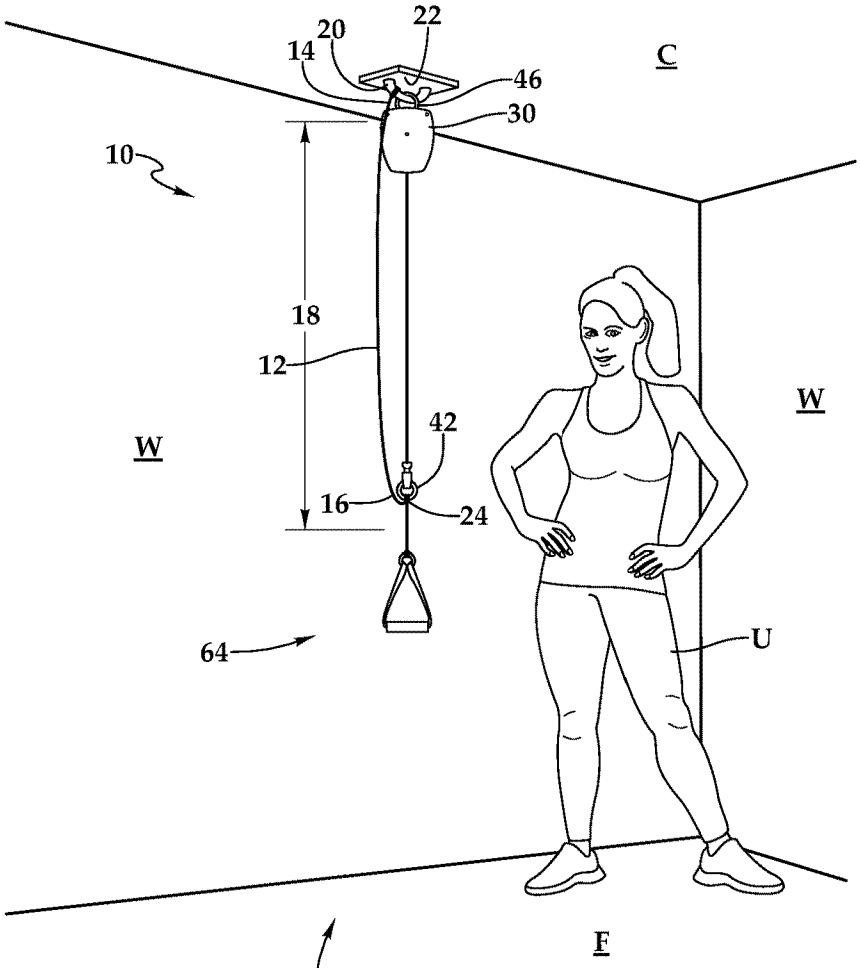
FIG. 3 is a front perspective view of the apparatus for providing suspension and resistance training depicted in FIG. 1 in a third position.

In the illustrated embodiment, the apparatus 10, which may provide suspension and resistance training to a user U, includes a main strap 12 having an upper end 14 and a lower end 16 with a length 18 (as best seen in FIG. 3) therebetween. The upper end 14 includes a fastener 20 for engaging an anchor 22, which is secured to the ceiling C. The anchor 22 is a permanent or semi-permanent point-of-connection. At the other end, the lower end 14 includes a connection point 24 for accepting a load, such as a human load as depicted by the user U. The connection point 24 serves a temporary point-of-connection, which is the opposite of the anchor 22. A retraction unit 30 includes a housing 32 with a reel 34 mounted in the housing 32 for rotation. A retraction spring 36 is located on the reel 34 and a retractable cable 38 is carried on the reel 34, with an inner end 40 of the retractable cable 38 connected to the reel 34, and a ring end fitting 42 carried on an outer end 44 of the retractable cable 38.

The retraction unit 30 may have a coupling member 46 securing the retraction unit 30 to the fastener 20. The main strap 12 is threaded through the ring end fitting 42 and, in one implementation, the main strap 12 is threaded through the ring end fitting 42 in a non-load redundancy manner. The ring end fitting 42 of the retraction unit 30 accepts a main strap load of the main strap, without a load. That is, the retraction unit 30 accepts an unloaded main strap load. The connection point accepts a greater load than the ring end fitting.

In operation, the apparatus 10 may have an unloaded retracted configuration 60 (please see FIG. 1), one or more transition configurations 62 (please see, for example, FIG. 2), and an extended configuration 64 (please see FIG. 3). In the unloaded retracted configuration 60, the retractable cable 38 is at least partially retracted into the retraction unit 30 and the length 18 of the main strap 12 is less than fully extended. In the extended configuration 64, the retractable cable 38 is fully extended and the length 18 of the main strap 12 is fully extended with the main strap 12 having a non-load transferring relationship to the retraction unit 30.

When it is desired to unreel or extend the apparatus 10, the user U moves the ring end fitting 42 radially inward, then the user U pulls the ring end fitting 42 until the apparatus is positioned in the extended configuration 64. When it is desired to reel or retract the apparatus 10, the user U pulls the ring end fitting 42 gently beyond the extended configuration 64 and the retraction unit 30 reels in the retractable cable 38 to retract the apparatus 10. This action proves very useful for storage of the apparatus 10. By way of example, on occasion, studios, such as gyms, will maintain dedicated group fitness space for suspended training, however, most multi-use studios make provisions for temporary and semi-permanent mounting of suspension training equipment, including components and appurtenances which can often create visual and physical impediments into the space. The apparatus 10 may easily be stored when not needed and quickly deployed as required.

Figure 7:
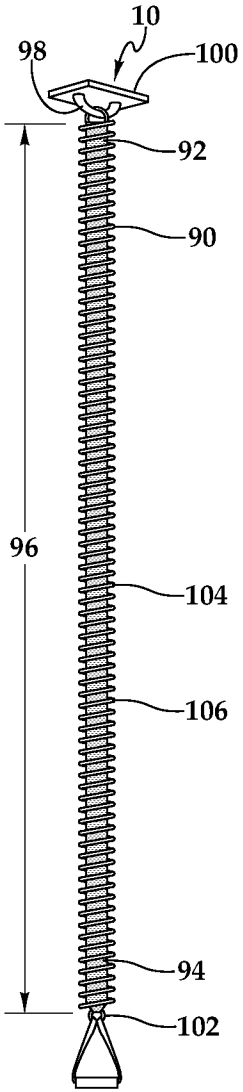
FIG. 7 is a front perspective view of the apparatus for providing suspension and resistance training depicted in FIG. 6 in a second position.
Figure 6:
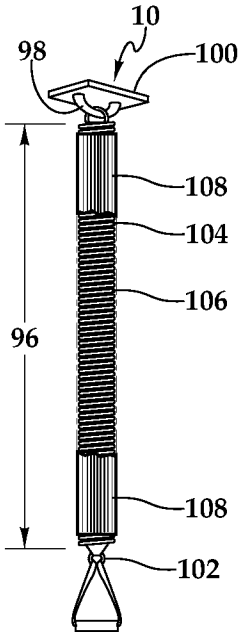
FIG. 6 is a front perspective view of another embodiment of an apparatus for providing suspension and resistance training in a first position, according to some exemplary aspects of the teachings presented herein.
Figure 5:
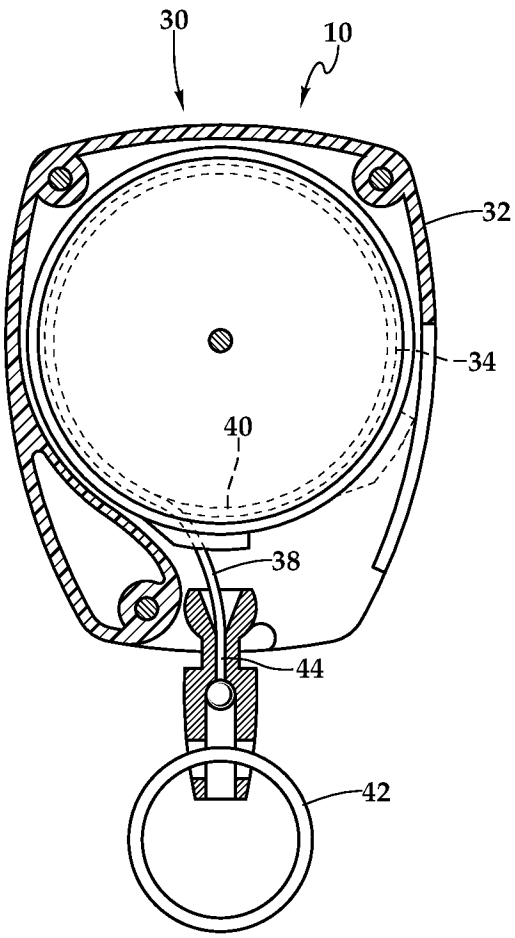
FIG. 5 is a front elevation view, in partial cross-section, of a retraction unit, which forms a portion of the apparatus for providing suspension and resistance training depicted in FIG. 1.

Referring now to FIG. 6 and FIG. 7, in some other embodiments, the apparatus 10 for providing suspension and resistance training includes a main strap 90 having an upper end 92 and a lower end 94 with a length 96 therebetween. The upper end 92 includes a fastener 98 for engaging an anchor 100 and the lower end 94 includes a connection point 102 to accept a load. At least a portion of the main strap 90 includes an engineered stretchable cord 104, which may be a spring coil 106 around the main strap 90. A sheath 108 is depicted as covering the spring coil 106 (partially shown and best seen in FIG. 6). In an extended configuration, the engineered stretchable cord 104 is fully extended and the length 96 of the main strap 90 is fully extended. In this extended configuration, the main strap 90 has a non-load transferring relationship to the engineered stretchable cord 104. In an unloaded retracted configuration, the engineered stretchable cord 104 is at least partially retracted and the length 96 of the main strap 90 is less than fully extended.

Figure 9:
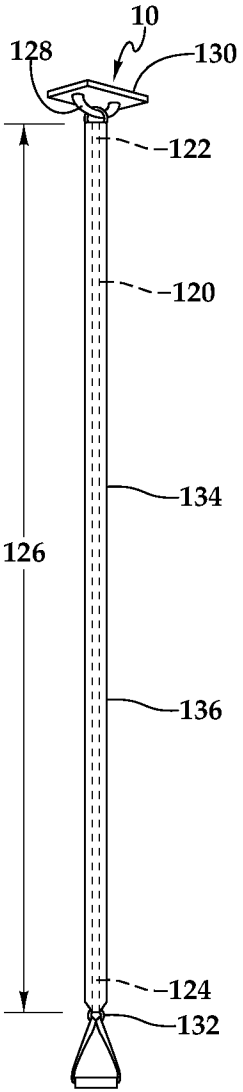
FIG. 9 is a front perspective view of the apparatus for providing suspension and resistance training depicted in FIG. 8 in a second position.
Figure 8:
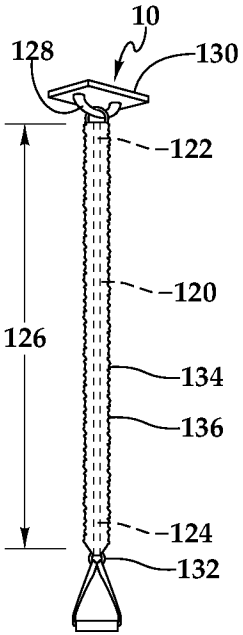
FIG. 8 is a front perspective view of a further embodiment of an apparatus for providing suspension and resistance training in a first position, according to some exemplary aspects of the teachings presented herein.

Referring now to FIG. 8 and FIG. 9, in some still other embodiments, the apparatus 10 for providing suspension and resistance training includes a main strap 120 having an upper end 122 and a lower end 124 with a length 126 therebetween. Similar to other embodiments presented hereinabove, the upper end 122 includes a fastener 128 for engaging an anchor 130 and the lower end 124 includes a connection point 132 that accepts a load, such as the previously discussed user U. As also mentioned, at least a portion of the main strap 120 includes an engineered stretchable cord 134, which may be a bungee cord 136 at least partially integrated with the main strap 120.

In an extended configuration, the engineered stretchable cord 134 is fully extended and the length 126 of the main strap 120 is fully extended while the main strap 120 has a non-load transferring relationship to the engineered stretchable cord 134. In an unloaded retracted configuration, the engineered stretchable cord 134 is at least partially retracted and the length of the main strap 120 is less than fully extended.

Relative terms, such as, but not limited to, "upper," "lower," "front," "inner," or "outer" have been used herein to describe one element's relationship to another element as illustrated in the figures. Such relative terms are intended to encompass different orientations of the device in addition to the orientation depicted in the figures and the use of such relative terms should not be construed as limiting. Further, the order of execution or performance of the methods and techniques illustrated and described herein is not essential, unless otherwise specified. That is, elements of the methods and techniques may be performed in any order, unless otherwise specified, and that the methods may include more or less elements than those disclosed herein. For example, it is contemplated that executing or performing a particular element before, contemporaneously with, or after another element are all possible sequences of execution.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. An apparatus for providing suspension and resistance training, the apparatus comprising:

a main strap having an upper end and a lower end with a length therebetween, the upper end including a fastener for engaging an anchor, the lower end including a connection point, the connection point accepting a load;

a retraction unit having a housing with a reel mounted in the housing for rotation, a retraction spring for the reel, and a retractable cable carried on the reel, with an inner end of the retractable cable connected to the reel, and a ring end fitting carried on an outer end of the retractable cable;

the retraction unit having a coupling member securing the retraction unit to the fastener, the retraction unit providing non-load redundancy to the main strap;

the main strap being threaded through the ring end fitting;

an extended configuration wherein the retractable cable is fully extended and the length of the main strap is fully extended, the main strap having a non-load transferring relationship to the retraction unit in the extended configuration; and an unloaded retracted configuration wherein the retractable cable is at least partially retracted into the retraction unit and the length of the main strap is less than fully extended.

2. The apparatus as recited in claim 1, wherein the connection point accepts a human load.

3. The apparatus as recited in claim 1, wherein the ring end fitting of the retraction unit accepts a main strap load.

4. The apparatus as recited in claim 1, wherein the ring end fitting of the retraction unit accepts an unloaded main strap load.

5. The apparatus as recited in claim 1, wherein the connection point accepts a greater load than the ring end fitting.

6. The apparatus as recited in claim 1, wherein the main strap is threaded through the ring end fitting in a non-load redundancy manner.

7. An apparatus for providing suspension and resistance training, the apparatus comprising:

a main strap having an upper end and a lower end with a length therebetween, the upper end including a fastener for engaging an anchor, the lower end including a connection point, the connection point accepting a greater load than a ring end fitting;

a retraction unit having a housing with a reel mounted in the housing for rotation, a retraction spring for the reel, and a retractable cable carried on the reel, with an inner end of the retractable cable connected to the reel, and the ring end fitting carried on an outer end of the retractable cable;

the retraction unit having a coupling member securing the retraction unit to the fastener, the retraction unit providing non-load redundancy to the main strap;

the main strap being threaded through the ring end fitting in a non-load redundancy manner;

an extended configuration wherein the retractable cable is fully extended and the length of the main strap is fully extended, the main strap having a non-load transferring relationship to the retraction unit in the extended configuration; and an unloaded retracted configuration wherein the retractable cable is at least partially retracted into the retraction unit and the length of the main strap is less than fully extended.

8. The apparatus as recited in claim 7, wherein the connection point accepts a human load.

9. The apparatus as recited in claim 7, wherein the ring end fitting of the retraction unit accepts a main strap load.

10. The apparatus as recited in claim 7, wherein the ring end fitting of the retraction unit accepts an unloaded main strap load.

* * * * *